US007385131B2

(12) United States Patent
Clift

(10) Patent No.: US 7,385,131 B2
(45) Date of Patent: Jun. 10, 2008

(54) METHOD AND APPARATUS OF MUSIC OBFUSCATION TO LIMIT UNAUTHORIZED PLAYBACK

(75) Inventor: Pamela K. Clift, Vacaville, CA (US)

(73) Assignee: Burgett, Inc., Sacramento, CA (US)

( * ) Notice: Subject to any disclaimer, the term of this patent is extended or adjusted under 35 U.S.C. 154(b) by 0 days.

(21) Appl. No.: 11/494,020

(22) Filed: Jul. 26, 2006

(65) Prior Publication Data

US 2007/0044640 A1 Mar. 1, 2007

Related U.S. Application Data

(60) Provisional application No. 60/703,719, filed on Jul. 29, 2005.

(51) Int. Cl.
*A63H 5/00* (2006.01)
*G04B 13/00* (2006.01)
*G10H 7/00* (2006.01)

(52) U.S. Cl. ..... 84/609; 84/645; 705/51

(58) Field of Classification Search ..... 84/609, 84/645; 705/51
See application file for complete search history.

(56) References Cited

U.S. PATENT DOCUMENTS 5,883,957 A * 3/1999 Moline et al. ..... 705/57
6,577,339 B1 6/2003 Thompson et al.
6,798,885 B1 * 9/2004 Malcolm ..... 380/42
6,884,993 B2 4/2005 Ahten et al.
7,102,071 B2 * 9/2006 Tada ..... 84/609
7,253,351 B2 * 8/2007 Aoki et al. ..... 84/600
2006/0027078 A1 * 2/2006 Kawashima ..... 84/609
2006/0048633 A1 * 3/2006 Hoguchi ..... 84/600

* cited by examiner

*Primary Examiner*—Jeffrey Donels
(74) *Attorney, Agent, or Firm*—John P. O'Banion

(57) ABSTRACT

A method and apparatus for limiting which player pianos can properly play notes within a media file or stream without playing additional "bad notes" encoded in the stream for disrupting the playback of that musical composition so as to prevent playback on unauthorized systems. Bad notes are encoded within a file or stream containing the proper "good notes" of the composition along with control commands to allow identifying the bad notes (e.g., by location, relative position, characteristics and so forth). Player pianos of a first manufacturer, having the proper programming, properly decode the control commands to locate the bad notes and prevent them from being played back with the good notes, therein properly rendering the musical composition. Player pianos from other manufacturers will play all the notes thus obfuscating the playback of the musical composition. Fidelity of playback on authorized system is not affected.

20 Claims, 6 Drawing Sheets

METHOD AND APPARATUS OF MUSIC OBFUSCATION TO LIMIT UNAUTHORIZED PLAYBACK

CROSS-REFERENCE TO RELATED APPLICATIONS

This application claims priority from U.S. provisional application Ser. No. 60/703,719, filed on Jul. 29, 2005, incorporated herein by reference in its entirety.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to musical instruments, and more particularly to a method and system of obfuscating playback of a note stream, or file, on player piano systems from other manufacturers.

2. Description of Related Art

Many different manufacturers of electronic player piano systems exist. A large portion of these systems utilize the Musical Instrument Data Interface standard (MIDI) for storing note information on a media. In this MIDI standard the music is not captured as with analog or digital recording techniques, but instead the activation of notes for a given instrument is represented by note commands which contain information as to which note (e.g., pitch), how that note is played (e.g., velocity of key strike), and so forth.

A problem has arisen in the use of player piano MIDI files wherein users purchase media from Manufacturer A to use on the player piano system of Manufacturer B. In many cases the user attempts to use the media in this way because Manufacturer B may be a "copy cat" low-end manufacturer that desires to sell systems without providing proper support.

Accordingly, a need exists for a system and method for limiting unauthorized use of the player piano media on player pianos of other manufacturers.

BRIEF SUMMARY OF THE INVENTION

A method and apparatus are described for preventing unauthorized playback of musical composition media on musical instruments, such as player pianos, from different manufacturers. These musical instruments are configured for generating audio output in response to receiving a stream of note commands and control commands contained within a stream or file. The notes in the file are "played" by the musical instrument in order to render a given musical composition.

To prevent unauthorized playback, the system described herein includes additional notes in the note stream, in particular a plurality of "bad" notes which are added to the "good" notes that make up the musical composition, as well as special identifiers which allow musical instruments with properly configured software (e.g., authorized systems) to locate the "bad" notes and differentiate them from the "good" notes. Musical instruments of other manufacturers, however, which lack this proper decoding means, will play back both the good and bad notes thus preventing proper playback of the composition and generating a cacophony of sounds instead of the desired composition.

The invention is amenable to being implemented and/or described in a number of ways, including but not limited to the following.

One implementation of the invention can be generally described as a method of encoding a file or stream of note information to prevent unauthorized playback of a musical instrument note sequence, comprising: (a) accessing a file or stream of note information in the form of note commands for a plurality of "good notes" within the within a music composition, the note commands configured for directing the playback of a musical piece on a musical instrument containing the good notes; (b) inserting note commands for a plurality of additional notes that are not part of the music composition, the additional notes comprising a plurality of notes being referred to as "bad notes"; and (c) inserting control commands containing identifiers to locate these "bad notes", known as bad note identifiers inserted within the file or stream; wherein the control commands which contain bad note identifiers are configured for interpretation by a musical instrument controller which decodes the control commands to identify and ignore the plurality of bad notes which are not played during playback; and wherein a musical instrument controller that cannot properly decode the note identifiers will play both good and bad notes therein at least substantially obfuscating the music composition that is being played back containing the plurality of the bad notes.

It should be appreciated that typically, the bad notes are encoded within the file or stream prior to distribution on a physical media or a downloadable media. In this case the note commands for the bad notes are inserted in the sequence of note commands, in the file or stream, for example where sufficient spacing exists between the good notes. In one mode of the invention, the bad note identifiers indicate the position, or timing, or characteristics of the bad notes, or any combination of position, timing and characteristics of the bad notes, by which the bad notes can be differentiated from the good notes contained within the file or stream of note information, although it should be appreciated that any means of identifying the bad notes can be utilized herein without departing from the teachings of the invention. In one mode the system is adapted for generating bad note identifiers which are configured to encode bad note identity information according to at least two different identification mechanisms thus mitigating against reverse engineering of media formats by unscrupulous manufacturers.

The file or stream of note information can comprise a Musical Instrument Data Interchange (MIDI) protocol for note and command encoding, and other note encoding formats. Insertion location of the bad notes can be performed as desired, such as in response to good note spacing, predetermined patterns, random patterns, or any combination of good note spacing, predetermined patterns and random patterns. The pitch of the bad notes can also be determined by any desired mechanism, such as in response to predetermined patterns, patterns based on adjacent notes, random patterns, or any combination of predetermined patterns, adjacent note patterns, random patterns, and so forth or any combination thereof. The method is particularly well suited for use on a musical instrument, for example an acoustic player piano.

An implementation of the invention may also be described as a method of decoding and playing notes from a file or stream received by a musical instrument, comprising: (a) accessing a file or stream of note information which comprises note commands for good notes (notes that are part of the musical composition) and bad notes (notes which are not part of the musical composition), and control commands containing any desired form of bad note identifiers; (b) decoding control commands contained within the file or stream of note information that identify the location of bad notes within the file or stream; (c) detecting bad notes within the file or stream of note information; and (d) generating output signals for a musical instrument to play the good notes contained in the file or stream of note information and ignore the bad notes which have been detected within the file or stream of note information. It will be appreciated that a musical instrument whose electronics are not configured for properly decoding the control commands identifying the location of bad notes within the file or stream will play both good and bad notes, such that playing of the bad notes obfuscates the musical piece.

An implementation of the invention can be described as an apparatus for controlling note playback on a player piano, comprising: (a) a communications circuit adapted for retrieving a stream of note commands and control commands within a player piano note and control stream from a data source; wherein the player piano note and control stream includes a plurality of bad notes and information about the location of the bad notes; (b) actuators configured for activating the keys of the piano to generate audible music composition; (c) means for controlling the actuators to correctly reproduce music contained in the player piano note and control stream retrieved from the data source; and (d) means for determining the location of bad notes within the stream of player piano notes and control codes and ignoring those bad notes so that proper musical playback is achieved without activating the actuators in response to the bad notes.

According to one aspect of the invention, a combination of the means for controlling the actuators and the means for determining the location of bad notes, comprises: (a) a computer configured for receiving the player piano note and control stream; and (b) a memory containing programming executable on the computer for, (b)(i) detecting bad notes within the stream of note commands and control commands in response to bad note information encoded within the piano note and control stream, and (b)(ii) generating output signals to activate the actuators in response to a sequence of good notes contained within the piano note and control stream while ignoring, and thus not playing, the bad notes which have been detected.

Embodiments of the present invention can provide a number of beneficial aspects which can be implemented either separately or in any desired combination without departing from the present teachings.

An aspect of the invention is to provide a means of mitigating against the use of MIDI music data files on systems marketed by other manufacturers.

Another aspect of the invention is to provide for selective obfuscation of the original sequence of musical notes with bad notes within the music file.

Another aspect of the invention is to provide for encoding of bad notes within a MIDI stream and the inclusion of identifiers within the stream which regulate detecting and eliminating the bad notes in response to the execution of note playback software within systems of the original equipment manufacturer.

Another aspect of the invention is to provide selected obfuscation of note information without departing from the MIDI standard.

Another aspect of the invention is to provide a system of protecting musical content that can be implemented readily.

Another aspect of the invention is to provide a system of protecting musical content that can not be readily reverse-engineered.

Another aspect of the invention is to provide a system of protecting musical content that allows media containing note content to be generated using bad note encoding according to different formats without altering the software of the music playback system.

Another aspect of the invention is to provide a system of protecting musical content which does not adversely affect playback for the original equipment manufacturer.

A still further aspect of the invention is to provide a system of protecting musical content which does not impact the ability to perform fast forward, rewind, and other playback operations for the original equipment manufacturer.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 5. It will be appreciated that the apparatus may vary as to configuration and as to details of the parts, and that the method may vary as to the specific steps and sequence, without departing from the basic concepts as disclosed herein.

The invention encodes incorrect notes within the note data (e.g., MIDI stream) associated with a musical performance in order to discourage playback on non-approved devices, such as player pianos produced by other manufacturers.

Figure 1:
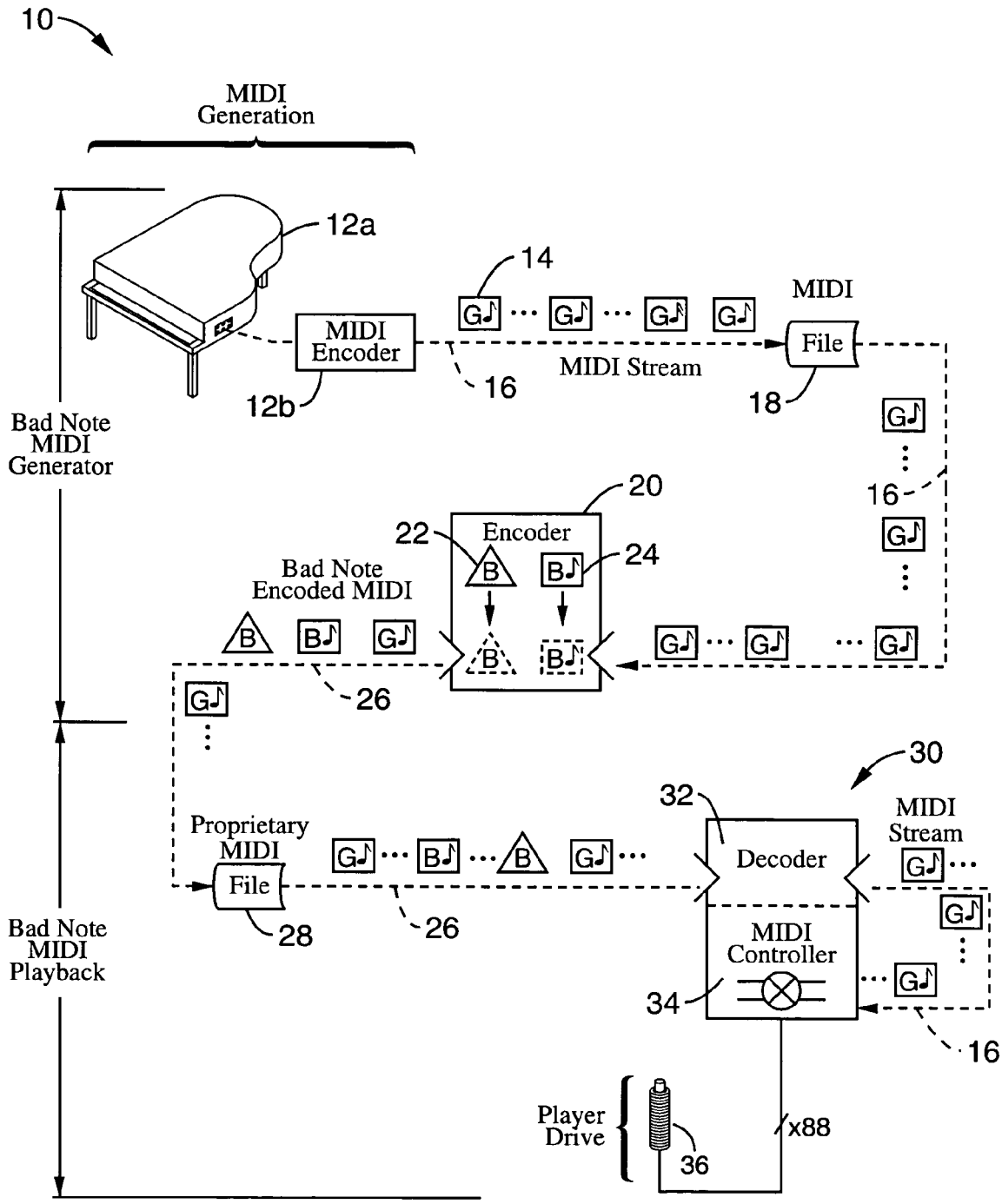
FIG. 1 is a block diagram of encoding and decoding bad notes within a MIDI stream according to an embodiment of the present invention.

FIG. 1 illustrates by way of example, an embodiment 10 showing the creation of a MIDI stream, or file, and the conversion of that MIDI stream, or file, into a bad note encoded MIDI stream for playback on a proprietary player piano controller system.

A MIDI stream is shown being created from musical instrument 12*a*, depicted as a player piano, whose keystroke information during a performance is output to a MIDI encoder 12*b*. Although shown as external, it should be appreciated that MIDI encoder 12*b* can be internal or external to instrument 12*a*. The notes which are struck by the performer, comprising a series of "good" notes 14, have been encoded as a MIDI stream 16. MIDI stream 16 can be coded with all conventional notes and commands, or the stream may include specialty commands associated with the given instrument 12*a* or MIDI encoder 12*b* for the recording session. The notes from the MIDI stream are shown captured within file 18, because typically the recording takes place at a different time, and/or place than the subsequent processing of the MIDI data. It should also be appreciated that a MIDI stream, or file, can be generated from any desired source, and that a MIDI stream can be received from a file or stored in a file.

To militate against playback on systems from other manufacturers, a series of bad notes are encoded within the bit stream and information is provided in one or more formats as a means of discerning the "bad" notes from the "good" notes. In one mode of the invention, information for discerning the bad notes from the good notes is encoded as commands within the MIDI stream which identify bad notes, such as by position, location, note information, timing and so forth. Alternatively, the bad note information can be encoded in a separate string, or a combination of MIDI file warnings and separate strings.

To encode the bad notes, a MIDI stream 16, or file, is received by encoder 20, wherein bad note warnings 22 and bad notes 24 are inserted within the MIDI stream to create a bad note encoded MIDI stream 26. It should be appreciated that each bad note, although depicted as a single command, would typically comprise a key-on and key-off command with appropriate timing, while the 'warning' may comprise information in any desired form from which the bad note can be identified from the remaining notes. In one mode, the MIDI custom commands are utilized for referring to the position of the bad note. The bad note stream 26 is stored in a file format 28, such as by the manufacturer, wherein bad note encoded performances can be copied on media, or otherwise distributed to customers.

Encoder 20 can be implemented in any number of devices that contain a programmable processing element, such as a computer, microprocessor, microcontroller, processor arrays, and so forth. For example, the encoder can be implemented as an application program for execution on a personal computer system, wherein bad note encoded MIDI files are generated in response to receiving conventional MIDI music files that describe notes and playback information for good notes without the bad note encoding. Programming executable on encoder 20 can be preferably executed on either files or streams to generate a new file or stream containing both the desired musical note information as well as a plurality of "bad notes", and associated bad note identifiers so that the processor within the musical instrument can play back the good notes and ignore the bad notes. Programming for encoder 20 is configured for inserting a plurality of bad note commands 24 and bad note identification information 22 within the stream or file of note information.

According to other bad note identification modes, the bad note can be referred to as being the next note having certain criterion, such as note pitch and velocity. These parameters can be scrambled when contained within the bad note warning as desired to prevent reverse-engineering. Alternatively, the bad note warning may identify subsequent good notes, their position, or their timing, from which the bad notes can be identified. It should be appreciated that identification of the position of the bad notes may take a number of alternative forms without departing from the teachings of the invention, and that these forms may be utilized singly or in various combination thereof.

Playback of bad note encoded MIDI file 26 on musical instrument 30 commences when a stream or file is received containing the note sequence. A decoder 32 is adapted for identifying and removing the bad notes to restore the stream back to its original form 16 containing all good notes. A controller 34 within the instrument interprets the MIDI codes to drive player output, such as a series (e.g., 88) of solenoids 36 for activating the piano keys. In one implementation, decoder 32 and MIDI controller 34 execute on the microprocessor of the instrument. It will be appreciated that the bad note decoding feature can be added to an existing controller by downloading or installing new firmware into the device. Alternatively, the decode and MIDI control portions can be executed separately, wherein the bad note decoding feature can be added to an existing device by installing a decoder board or unit.

During playback, the bad note encoded MIDI file is received by a musical instrument to play out the good notes. The musical instrument 30 is configured with a decoder means and a playback means, shown as decoder 32 and MIDI controller portion 34 for driving a set of actuators 36. The decoder and MIDI controller can be integrated within the same circuit, performed by separate circuits, integrated within other circuits, and combinations thereof without departing from the teachings of the present invention.

Decoder 32, and/or MIDI controller 34, within the musical instrument is preferably configured with a programmable processing element, such as a computer, microprocessor, microcontroller, processor arrays, and so forth. For example, the decoder can be implemented as programming executing on the processing element utilized for controlling the operations of the musical instrument. The programming is configured to register the control commands containing bad note information to detect the bad notes within the file or stream and to generate the output signals for playing back the good notes contained in the file, while ignoring and thus not playing the bad notes.

After bad note decoding has been performed, the timing of the original music is played back exactly the same as it was before the bad note events were inserted. Since the bad notes are digitally removed prior to playback, no distortion is introduced whatsoever. It is preferred that events are only inserted in locations within the MIDI stream where sufficient spacing exists between notes to make them distinct from one another, and to assure that no performance degradation is introduced on playing back good notes on authorized systems. By way of example, sufficient spacing in one embodiment requires that the time stamp difference between notes be greater than a predetermined time gap, such as a time gap of 200 mS between successive notes. In this instance the bad note would be inserted between the two notes with the time gap between the bad note and each bordering note of 100 mS. It will be appreciated that the bad note can be located anywhere between the two, although centering is described herein.

In one mode of the invention the pitch of the bad note is set to contrast with nearby notes, wherein its disruptive influence will clearly stand out. In addition, the volume of the bad notes can be set to a sufficiently high value making these notes sound all the more obnoxious during playback. It will be appreciated that a number of algorithms can be adopted for determining the note to be played as the bad note. One simple mechanism for selecting the note value for a bad note, adds an offset value to the prior note, or succeeding note, for instance an offset corresponding to a span of ¼ to ½ of the 88 piano keys available, with modulo wrap-around wherein the bad notes are always significantly "off key". In another example, the bordering keys are both checked and a note determined which is far from each. In another example, random notes can be generated, which are not necessarily distinguishable from adjacent notes, but overall will not follow the pattern of the good notes. One of ordinary skill in the art will appreciate that the programming can determine what note pitch to encode as a bad note based on these mechanisms or any of numerous additional selection mechanisms or combinations thereof without departing from the teachings of the present invention.

In one embodiment, the bad note warnings are encoded into the MIDI stream using special MIDI codes which reference the bad notes, such as by position, time, and so forth. For example, utilizing a note number value, although other mechanisms for describing bad note position can be utilized.

More than one bad note warning can be inserted for each bad note which has been inserted into the note stream to further guard from bad notes being played, such as when playback is interrupted with fast forward and reverse operations of the playback stream. During playback of the bad note encoded MIDI stream on systems from other manufacturers, the programming is not available to properly process these special MIDI codes, and certainly will not interpret them as bad note warnings. Additional bad note warnings can be sent as desired, for example to enhance the ability of detecting the bad notes regardless of fast forward and rewind operations. Recording can be modified to compensate for things like volume changes and so forth.

The note sequence in the player media is preferably loaded with sufficient bad notes that upon attempting to use the media on an unauthorized system it is audibly very apparent that compatibility is an issue, for example although the music may be heard, a cacophony of additional unharmonious notes are played wherein the piece of music is largely or totally obscured.

One embodiment of bad note encoding can be implemented by converting a conventional MIDI file by encrypting it with the bad notes along with command codes containing information which can be utilized for detecting the positions of the bad notes, thus allowing the decoder of the media manufacturer to remove the bad notes prior to output. When creating media for distribution the bad note encoding program can be setup as a command line executable program, or with a graphic user interface, or in an interpreted manner, or within any desired configuration that can operate on the file. One implementation of the bad note encoding program is configured for receiving user input to specify how the bad notes are to be encoded within the file, such as a selection of types of encoding, or providing specifics about how the encoding is to be performed.

The encoding program can be configured in any desired manner for receiving one or more files to be converted. In one mode, the bad note encoding program scans through the MIDI file and populates a table with the location of all the notes that are in the original file. Gaps between existing good notes are found and bad notes inserted therein according to one or more bad note insertion mechanisms. These bad note insertion mechanisms can be based on random bad note insertions at a predetermined percentage, a random level of bad note insertions, and so forth. The pitch and/or type of bad notes inserted can also be selected based on a program parameter, for example selecting the pitch relationship of the bad note to nearby "good" notes. For example, a bad note may be inserted as the following hexadecimal string: B0, 10, bad note (randomly picked from table), 80, bad note, 40, 90, bad note, velocity (between 95 and 127); and so forth. In this example the B0 control codes provide the warning that the indicated bad note is to be played on the PianoCD device, or whatever device the encoding process is directed towards. Another example string is listed in Table 1, showing code, data ($1_{st}$ byte and $2_{nd}$ byte) and description of command.

The bad note encoding routine can be adapted to perform the operations on one or more streams, files; or folders, from which a new file is generated which contains the bad notes and is marked to indicate a proprietary music file, such as changing a portion of the filename or extension.

In one mode of the invention, as a final step of conversion, a playback routine with a simulated output (preferably generated at a rate that is much faster than real time), decodes the encoded playback sequence and stores the notes, rather than playing them, into a MIDI test file as they would be played. After "playing back" the proprietary MIDI file, the temporary file created is compared with the original unconverted MIDI file. If the test file contains the same note sequence as the original MIDI file, then the conversion has been performed properly and the test file can be deleted. The simulation is preferably configured with a set of parameters establishing limits based on limitations associated with one or more authorized systems, wherein the simulations can test for worst case use, thus one test can assure proper playback on all authorized systems without the need to specifically perform testing on each one.

Figure 2:
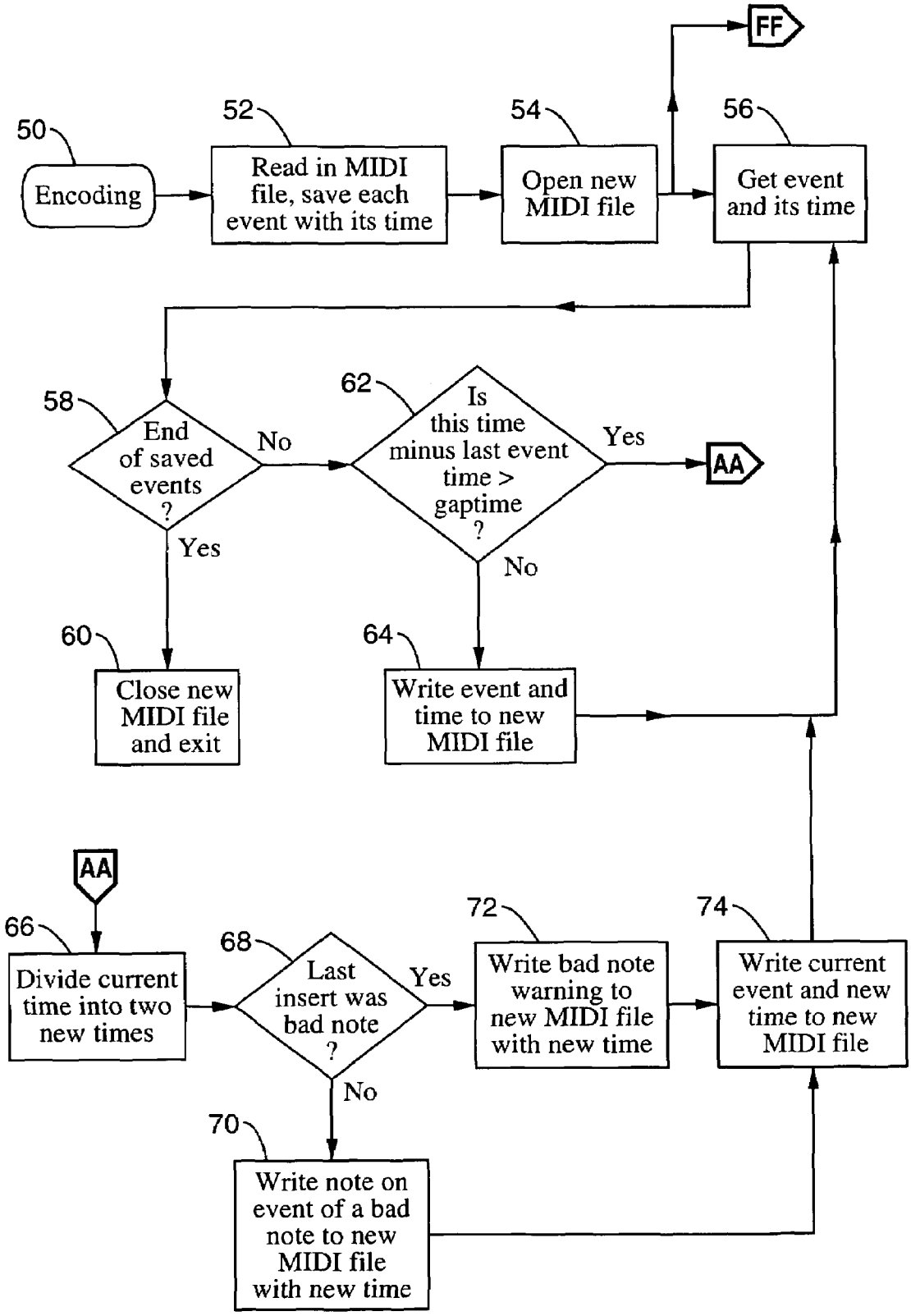
FIG. 2 is a flow diagram of bad note encoding according to an embodiment of the present invention.

FIG. 2 illustrates an example embodiment of the bad note encoding process commencing at block 50. These flowcharts are provided by way of example and not limitation, as one of ordinary skill in the art will appreciate that the bad note encoding and decoding described herein can be similarly obtained in accord with different programming steps. A MIDI source file is received as per block 52, with events saved with their respective times. A new MIDI file is opened for storing the bad note encoded MIDI file as per block 54. In block 56 an event with its respective time is retrieved from the saved file as received in block 52. If all events in the note stream have been processed, as detected in block 58, then any desired end of file strings are inserted with the bad note encoded MIDI file being closed as at block 60. If, however, additional notes need to be processed then a check is made as per block 62 to determine if sufficient time exists between successive notes for inserting a bad note. If insufficient time exists, then the good note is written to the bad note encoded MIDI file as per block 64, and another event is retrieved as per block 56.

When sufficient time between notes exists, bad note encoding is shown on connector AA into block 66 wherein the available time is divided into two new times. If the last insert was not a bad note, as detected by block 68, then a bad note is written to the bad note encoded file as per block 70. However, when the last insert was a bad note, as determined in block 68, then a bad note warning is written to the bad note encoded MIDI file with a new time at block 72. After which the current event and new time are written to the bad note encoded file as per block 74, whereafter the next event is retrieved as per block 56.

Figure 3:
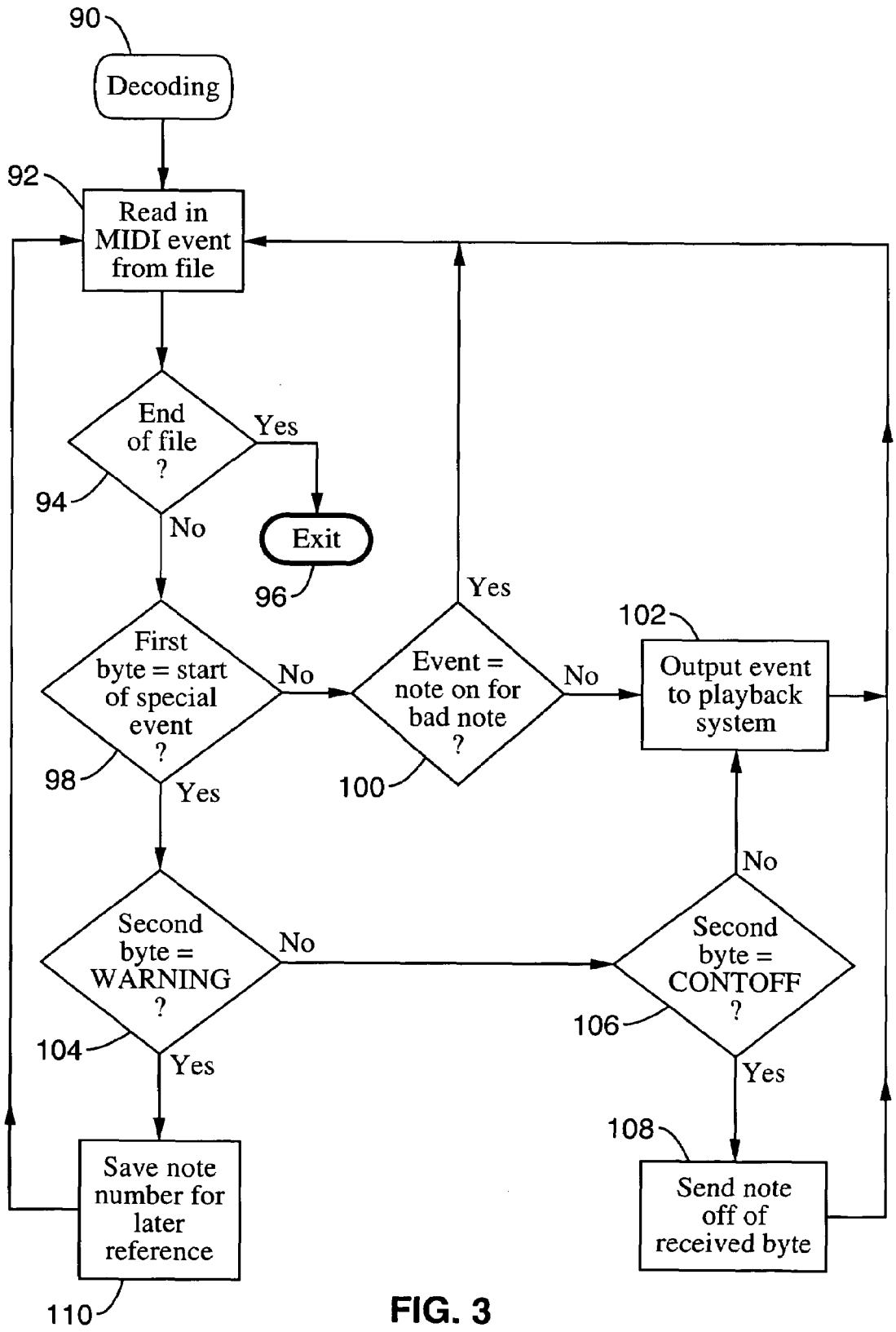
FIG. 3 is a flow diagram of bad note decoding according to an embodiment of the present invention.

FIG. 3 illustrates an example of the bad note decoding process corresponding to the bad note encoding example shown in FIG. 2. Decoding commences as represented at block 90 after which a MIDI event is retrieved from the file at block 92. If the end of the file is detected by block 94 then the decoding process terminates as given by block 96. If the first byte of an event, as detected by block 98, signals something other than the start of a special event, then it is checked for other types of events. If the event signals a note on for a bad note as per block 100, then it is ignored with processing returning to read another event as per block 92. If the event is not a special event or a note on for a bad note, then the event is output to the playback system, wherein the event is executed or the associated note played, as given by block 102. It should be appreciated that additional types of events can be supported as desired.

In the case of the event detected in block 98 being a special event, then the second byte is checked as per block 104. In the case of the byte being a bad note warning, then the information about the bad note is saved for use by block 100 in a later reference at block 110, after which the next event is retrieved at block 92. If the second byte is not a warning, as determined at block 104, but instead is a note off command, as detected at block 106, then the given note is turned off as per block 108, with a return to block 92. If the second byte is not for turning off the note then the event is output to the system as per block 102.

Figure 4A:
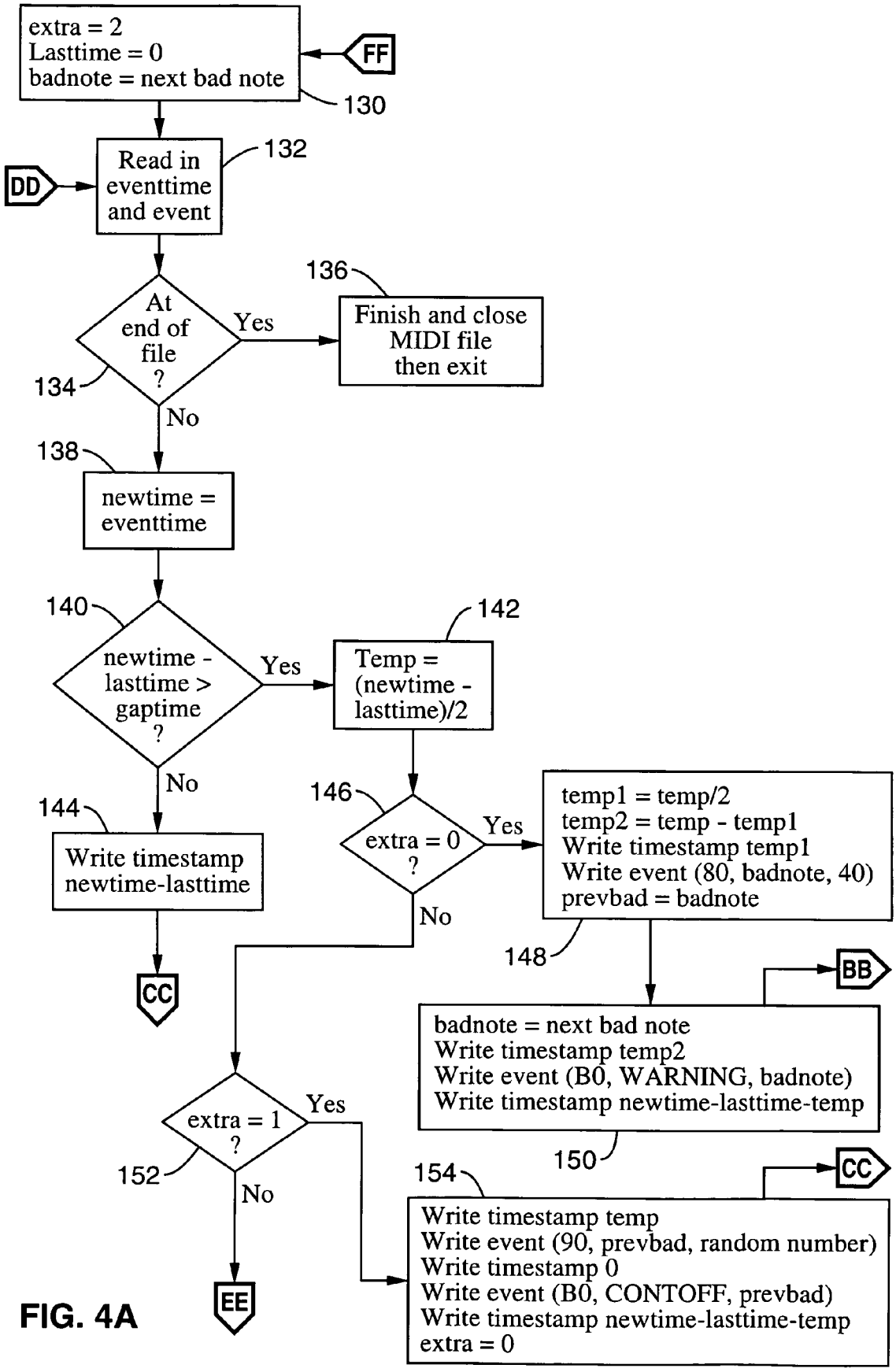
FIGS. 4A-4B are flow diagrams of bad note encoding according to an embodiment of the present invention.
Figure 4B:
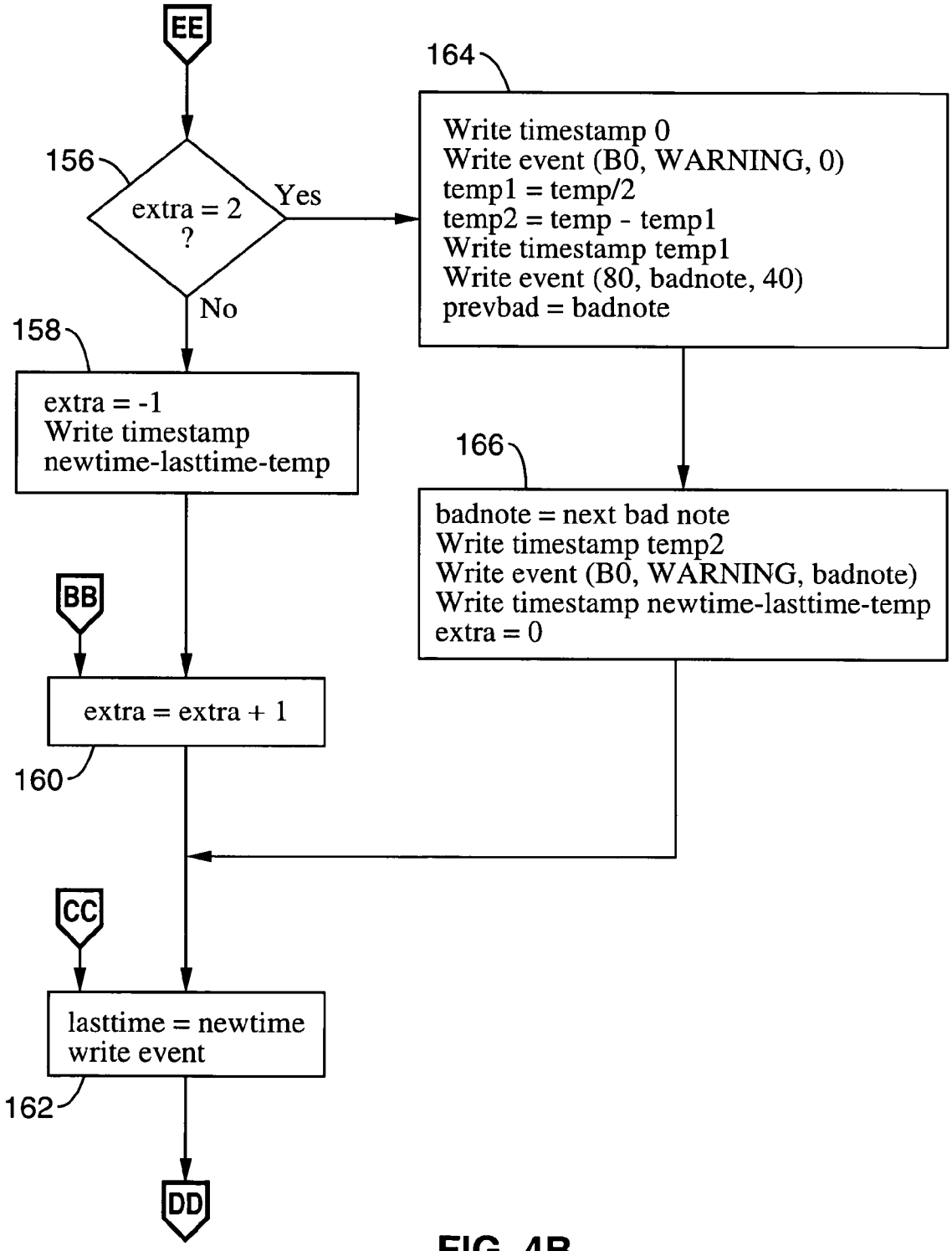

FIG. 4A and FIG. 4B illustrate note encoding within a MIDI stream or file. These flowcharts provide a more detailed embodiment than described in FIG. 2. This figure follows in the same vein as the start of FIG. 2 after blocks 50 through 54 through connector FF after which at block 130 the parameters are set, with the eventtime value then being read as represented by block 132. If the end of file is reached as detected at block 134, then the MIDI file is closed as per block 136 after which the routine exits. If end of file has not been reached then newtime is set to eventtime at block 138. If newtime-lasttime does not exceed gaptime as determined at block 140, then timestamp is set to value (newtime-lasttime) which is written to the new MIDI file as per block 144 with execution proceeding on via connector CC to block 162 in FIG. 4B. Otherwise, newtime-lasttime exceeds gaptime at block 140 wherein Temp is set to a time value between the events, specifically to a value of (newtime-lasttime)2 as shown in block 142.

If the extra note flag is not set, as determined in block 146, then the time represented by (newtime-lasttime) is divided into three different timestamps in block 148. The actual times used are arbitrarily insofar as the three times add up to the value of (newtime-lasttime). The first timestamp is written to the new MIDI file, then a note off event is written using badnote as the note and this badnote is saved in prevbad for later use. In block 150 a new badnote is determined and the second timestamp is written to the new MIDI file with a bad note warning message. Then the third timestamp is written to the new MIDI file. Execution proceeds via connector BB into block 160 of FIG. 4B.

If the extra note flag was not set to zero as determined in block 146, and is found to be set to one as per block 152, then block 154 is executed wherein the time value temp is written as a timestamp in the new MIDI file and a note on event is written to the new MIDI file using prevbad as the note with a given velocity, such as random velocity. Next a timestamp of zero is written to the new MIDI file then a controller off event is written. Finally, the remaining time is written to the new MIDI file for the next timestamp. The extra note flag is then set to zero. Execution is routed through connector CC into block 162 of FIG. 4B. Otherwise, execution is routed from block 152 through connector EE to block 156 of FIG. 4B.

In FIG. 4B the extra note checking continues at block 156 with determining if the extra note flag is equal to two. If it is equal, then as per block 164 and block 166, the new MIDI file receives a timestamp of zero with a bad note warning event, a timestamp of half of temp and a note off event and the other half of temp as timestamp with a bad note warning event, and the remaining time as a timestamp. Variable prevbad saves the bad note for later use and a new bad note is determined. Variable extra is set to zero.

Otherwise if extra note flag is not equal to two, then the extra note flag is set to negative one as per block 158, then the timestamp is set to (newtime-lasttime) which is written to the new MIDI file, after which the extra note flag is incremented at block 160, and lasttime updated as per block 162, prior to execution returning through connector DD to block 132 of FIG. 4A.

Figure 5:
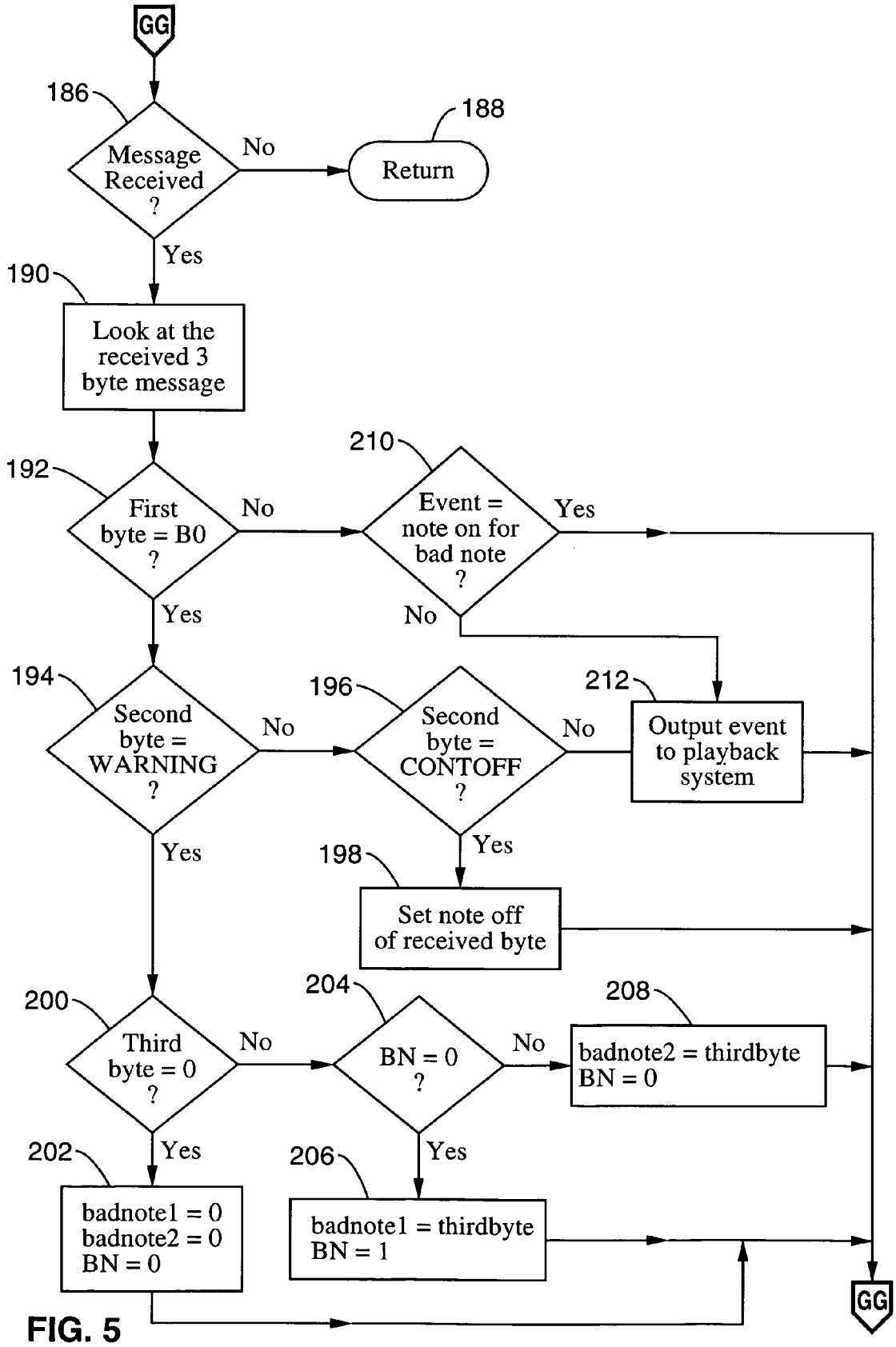
FIG. 5 is a flow diagram of bad note decoding according to an embodiment of the present invention.

FIG. 5 illustrates another example of bad note decoding in which a check is made for a message received at block 186. If not, then a return is made at block 188, otherwise the received three-byte message is checked in block 190 to see if it is a controller message as per block 192. If it is not a controller message, it is checked at block 210 to determine if it is a note on event for a bad note, wherein it is ignored and execution proceeds to block 186 through connector GG to check if another three byte message has been received. If the event is neither a controller message nor a bad note on event, then block 212 is executed to output the event to the playback system.

In the case of the event detected in block 192 being a controller event, then the second byte is checked as per block 194. If this byte is not a warning event, then the second byte is checked for an off event. If it is not an off event, then it is a normal MIDI message that gets sent to the playback system as in block 212. If it is an off event, a note off event is sent as per block 198 before returning to block 186. If the second byte is a warning indicator as determined in block 194, then the third byte is tested. If the third byte is zero then the bad note variables are reset as shown in block 202. If the third byte is not zero then the bad note flag is checked as shown in block 204. If the bad note flag is zero then the received bad note is saved in variable badnote1 as in block 206, otherwise the bad note is saved in variable badnote2 as in block 208. Execution proceeds back to block 186 via connector GG.

To thwart any attempts at reverse-engineering the bad note decoding process, it is preferred that the control programming of the player piano be adapted for recognizing more than one set of bad note indicators and variations thereof, and more preferably different mechanisms of locating bad notes. According to this mode of the invention, the media being distributed at any one time (e.g., media programmed by the manufacturer such as CDs, memory cards, and so forth; or downloaded content) is encoded with only a subset of the available bad note encoding, such as only one of the encoding methods, or a selected combination of encoding methods. An entire sequence of available bad note encodings thus remains available for later use on the distributed media without the need of modifying the programming of the player. The manufacturer can change encoding at any time, and in any of a number of ways to thwart use of the material on other machines without the need to change the firmware/software of the musical instrument player devices. It will be recognized that reverse-engineering would typically arise from a manufacturer comparing the proprietary MIDI file with a conventional MIDI file produced for the same piece of music. From this information they might attempt to adapt their programming to circumvent the proprietary encoding. However, even if they were to figure out how the encoding was performed on this one release of media, they would have no way at all to determine what other bad note encodings are supported for other media releases.

In making use of these varied forms of bad note encoding, the manufacturer can change the type of encoding performed at any desired time, such as at the time when the competitor adds the feature, wherein the competing system will not work on the new media, while systems of the original manufacturer will continue to play properly, without modification, using any of these media. For example, media being manufactured is first encoded with bad notes according to a first bad note location encoding description. Then at any desired time or when other manufacturers have adapted their player piano control programming to detect the bad notes, then the encoding of bad notes is changed to a second bad note encoding format which is already recognized by the player pianos associated with the media manufacturer. Since this second encoding is already configured for proper decoding by the programming of the player piano unit, the media being manufactured can be changed as desired to reduce the possibilities of reverse engineering by competitors. It should be appreciated that the firmware can be configured to handle any desired number of such bad note formats and the media encoded to include one or more of these bad note encoding formats in any release of the media.

The system and method of the present invention provides numerous benefits for the manufacturer creating and distributing composition media which contains note sequences for playback on musical instruments. For example, the system and method does not impact playback on authorized systems, is readily implemented, and can prevent reverse engineering.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

TABLE 1

Example Note Sequence

| Code | 1st Byte | 2nd Byte | Description |
|---|---|---|---|
| 80 | N0 | 40 | Key off, note number N0, vel = 40 |
| B0 | 21 | N1 | Ctrl Chg: PianoCD bad note N1 |
| 80 | N1 | 40 | Key off, note number N1, vel = 40 |
| B0 | 21 | N2 | Ctrl Chg: PianoCD bad note N2 |
| 90 | N1 | Vel | Key on, note number N1 |
| 80 | N2 | 40 | Key off, note number N2, vel = 40 |
| B0 | 21 | N3 | Ctrl Chg: PianoCD bad note N3 |
| 90 | N2 | Vel | Key on, note number N2 |
| 80 | N3 | 40 | Key off, note number N3, vel = 40 |
| B0 | 21 | N4 | Ctrl Chg: PianoCD bad note N4 |
| 90 | N3 | Vel | Key on, note number N3 |

What is claimed is:

1. A method of encoding a file or stream of note information to prevent unauthorized playback of a musical instrument note sequence, comprising:

accessing a file or stream of note information in the form of note commands for a plurality of good notes within a music composition described in a sequence of note commands and control commands, said note commands configured for directing the playback of a musical piece on a musical instrument;

inserting note commands into said file or stream for a plurality of additional notes that are not part of the music composition, said additional notes comprising a plurality of bad notes;

wherein playing of both said good and said bad notes within the file or stream of note information results in a cacophony of notes instead of the desired musical composition comprising only said good notes; and inserting control commands containing bad note identifiers for locating the bad notes inserted within the file or stream;

wherein said control commands which contain bad note identifiers are configured for interpretation by a musical instrument controller which decodes the control commands to identify and ignore said plurality of bad notes which are not played during playback; and wherein a musical instrument controller that cannot properly decode said note identifiers will play both good and bad notes therein obfuscating the music composition with the plurality of said bad notes.

2. A method as recited in claim 1, wherein said bad notes are encoded within said file or stream prior to distribution on a physical media or a downloadable media.

3. A method as recited in claim 1, wherein said note commands for said bad notes are inserted in the sequence of note commands, in said file or stream, where sufficient spacing exists between said good notes.

4. A method as recited in claim 1, wherein said bad note identifiers indicate the position, or timing, or characteristics of the bad notes, or any combination of position, timing and characteristics of the bad notes, by which the bad notes can be differentiated from the good notes contained within the file or stream of note information.

5. A method as recited in claim 1, wherein said bad note identifiers are configured to encode bad note identity information according to at least two different identification mechanisms.

6. A method as recited in claim 1, wherein said file or stream of note information comprises a Musical Instrument Data Interchange (MIDI) protocol for note and command encoding.

7. A method as recited in claim 1, wherein the location for the insertion of said bad notes is determined in response to good note spacing, predetermined patterns, random patterns, or any combination of good note spacing, predetermined patterns and random patterns.

8. A method as recited in claim 1, wherein the pitch of each said bad note inserted within the file or stream of note information is determined in response to predetermined patterns, patterns based on adjacent notes, random patterns, or any combination of predetermined patterns, adjacent note patterns, and random patterns.

9. A method as recited in claim 1, wherein said musical instrument comprises an acoustic player piano.

10. A method of decoding and playing notes from a file or stream received by a musical instrument, comprising:

accessing a file or stream of note information which comprises note commands for good notes and bad notes, and control commands containing bad note identifiers within a sequence of note commands and control commands;

wherein playing of both good and bad notes within the file or stream of note information results in the output of a cacophony of notes instead of a desired composition comprising only the good notes;

decoding control commands contained within the file or stream of note information that identify the location of bad notes within said file or stream;

detecting bad notes within the file or stream of note information; and generating output signals for a musical instrument to play the good notes contained in the file or stream of note information and ignore the bad notes which have been detected within the file or stream of note information.

11. A method as recited in claim 10:

wherein a musical instrument that cannot properly decode control commands identifying the location of bad notes within said file or stream, plays both good and bad notes; and wherein the playing of the bad notes obfuscates the musical piece.

12. A method as recited in claim 10, wherein said file or stream of note information comprises a Musical Instrument Data Interchange (MIDI) protocol for note and command encoding.

13. A method as recited in claim 10, wherein said musical instrument comprises an acoustic player piano.

14. An apparatus for controlling note playback on a player piano, comprising:

a communications circuit adapted for retrieving a stream of note commands and control commands within a player piano note and control stream from a data source;

wherein said player piano note and control stream includes a plurality of bad notes and information for identifying said bad notes from good notes which comprise a desired musical composition;

wherein playing back of both good and bad notes within the file or stream of note commands results in a cacophony of notes instead of the desired musical composition comprising only the good notes;

actuators configured for activating the keys of the piano to generate audible music composition;

means for controlling the actuators to correctly reproduce music contained in the player piano note and control stream retrieved from the data source; and means for identifying bad notes within the stream of player piano notes and control codes and ignoring those bad notes, and thus not sending them for playback, so that proper musical playback is achieved without activating said actuators in response to said bad notes.

15. An apparatus as recited in claim 14:

wherein said player piano note and control stream comprises a Musical Instrument Data Interchange (MIDI) protocol for note and command encoding; and wherein special command codes within the MIDI stream are used for encoding an identifier for the bad notes.

16. An apparatus as recited in claim 14, wherein a combination of said means for controlling the actuators and said means for identifying the location of bad notes, comprises:

a computer configured for receiving said player piano note and control stream; and a memory containing programming executable on said computer for, detecting bad notes within the stream of note commands and control commands in response to bad note information encoded within the piano note and control stream, and generating output signals to activate said actuators in response to a sequence of good notes contained within the piano note and control stream while ignoring, and thus not playing, the bad notes which have been detected.

17. An apparatus as recited in claim 14, wherein said bad notes are encoded within said player piano note and control stream prior to distribution on a physical media or a downloadable media for retrieval from a data source.

18. An apparatus as recited in claim 14, wherein said bad note information is encoded within the piano note and control stream according to at least two different bad note identification mechanisms.

19. An apparatus as recited in claim 14, wherein said player piano note and control stream comprises note commands for directing actuator activation for both good and bad notes, and control commands for differentiating the bad notes from the good notes.

20. An apparatus as recited in claim 14, wherein said bad notes are identified by information within said control commands indicating the position, or timing, or characteristics of the bad notes, or any combination of position, timing and characteristics of the bad notes.

* * * * *